US006233856B1

(12) United States Patent
Haugk et al.

(10) Patent No.: US 6,233,856 B1
(45) Date of Patent: May 22, 2001

(54) CONTAINER WITH THREE DIMENSIONAL DESIGNS

(75) Inventors: Peter Haugk, Lincoln Park; Teresa Pavlak, Fanwood; Donald Losier, Chester, all of NJ (US); Scott Docken, Eden Praire, MN (US); Rodney Prochaska, Montgomery, MN (US); David Segner, St. Bonifacius, MN (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/542,530

(22) Filed: Apr. 4, 2000

Related U.S. Application Data

(63) Continuation of application No. 09/337,780, filed on Jun. 22, 1999, now Pat. No. 6,073,373, which is a continuation of application No. 08/679,838, filed on Jul. 15, 1996, now Pat. No. 5,937,554.

(60) Provisional application No. 60/001,209, filed on Jul. 18, 1995.

(51) Int. Cl.[7] ..... G09F 3/00

(52) U.S. Cl. ..... 40/310; 40/427; 215/366

(58) Field of Search ..... 40/310, 427; 215/366

(56) References Cited

U.S. PATENT DOCUMENTS 2,305,890 * 12/1942 Moore ..... 40/310

4,871,077 * 10/1989 Ogden et al. ..... 215/366

FOREIGN PATENT DOCUMENTS 4-201853 * 7/1992 (JP) ..... 40/310

* cited by examiner

*Primary Examiner*—Cassandra H. Davis
(74) *Attorney, Agent, or Firm*—Michael J. McGreal

(57) ABSTRACT

A container has a label or decoration in the container and unattached to any interior surface. The label or decoration is in the form of a monolayer film or a laminate film with the decoration and other materials under a coating or within the laminate layers. A preferred mode is for the container to be a pump container having a constricted opening. The film will be of an elliptical to a rectangular shape. If rectangular the film will have rounded lower edges or a parabolic lower portion for ease of insertion into container openings. The container preferably will have grooves, projections or other techniques for stabilizing the film in the container. Monolayer films will have the decoration printed onto the surface and will have a protective coating over this surface. Laminate films can be of the same or dissimilar films with the printed surface between the laminate films. The useful adhesives for the films are those that are not affected by the product in the container. These include pressure sensitive adhesives, heat cured adhesives, catalytically cured adhesives, ultraviolet light cured adhesives and electron beam cured adhesives.

13 Claims, 4 Drawing Sheets

FIG. 1
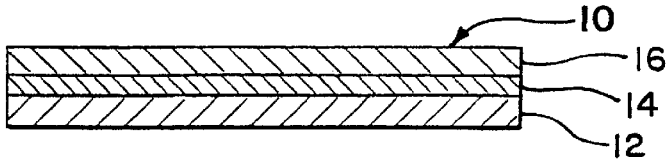
FIG. 2
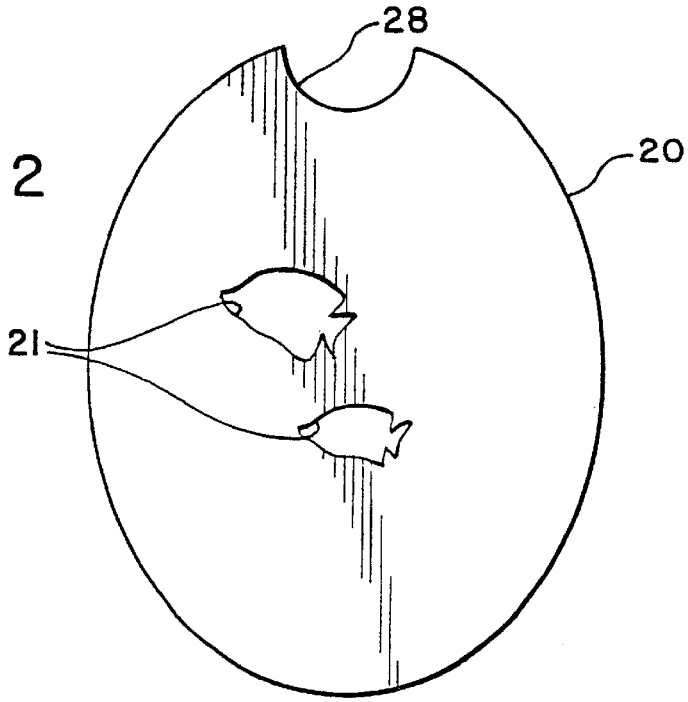
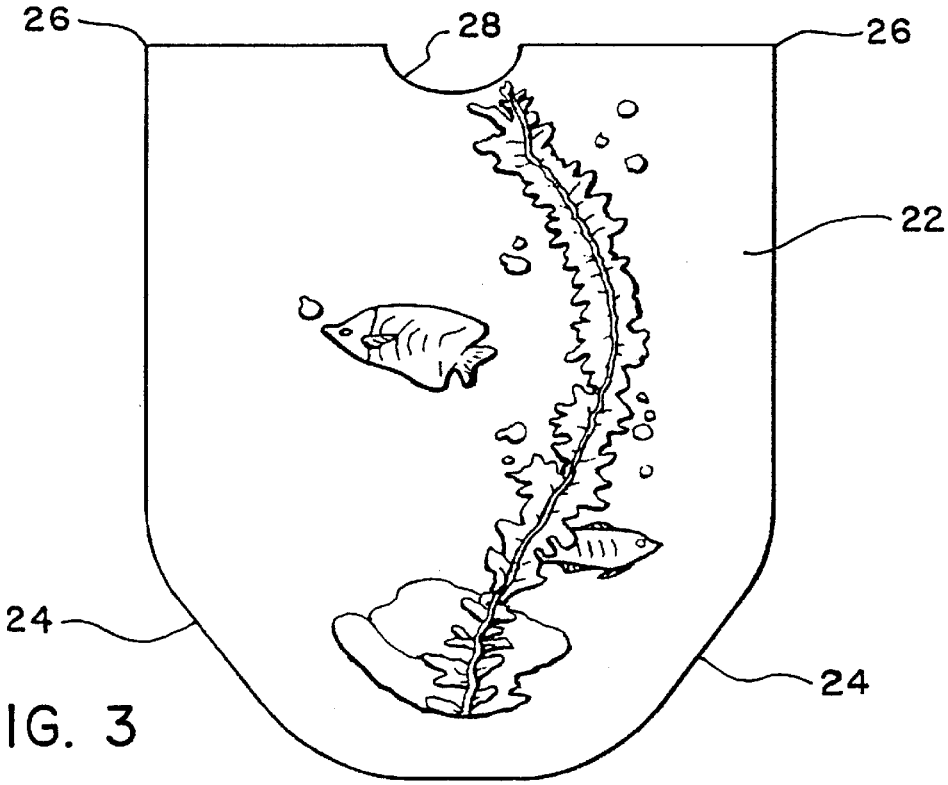
FIG. 3

CONTAINER WITH THREE DIMENSIONAL DESIGNS

This is a continuation of prior application Ser. No. 09/337,780 filed Jun. 22, 1999, which application is now U.S. Pat. No. 6,073,373 and is incorporated herein by reference and which is a continuation of Ser. No. 08/679,838 filed Jul. 15, 1996 which application is was issued as U.S. Pat. No. 5,937,554 on Aug. 17, 1999 and is incorporated herein by reference.

This invention relates to containers that have a three dimensional design as a part of its structure. More particularly, this invention relates to containers that have decorative films contained therein, the decorative films having designs that are complementary to designs on other surfaces of the bottle.

BACKGROUND OF THE INVENTION

There is a continuing need to provide better decoration for containers, and in particular for bottles. This is commonly achieved through the use of labels that are attached to one or more of the exterior surfaces of the container. It is necessary to attach the labels to the exterior surface of the containers when the containers are opaque or nearly opaque. However, when the container is transparent, or essentially transparent, the label and other decoration can be placed within the container. This is more so the case when the liquid in the container is transparent or essentially transparent. In such cases labels and other decoration can be attached to an interior surface of a bottle or may even float in the liquid in the bottle. In addition, there may be a cooperation between a label on one surface of a bottle and a label on another surface of a bottle.

U.S. Pat. No. 1,647,175 discloses a container that has a decorative object that is attached to the bottom wall of a bottle. This decorative object is fully contained within the bottle. U.S. Pat. No. 716,759 discloses a container with a label on two interior walls. Each label can be seen through the wall to which it is attached. U.S. Pat. No. 635,098, U.S. Pat. No. 2,305,890 and U.S. Pat. No. 4,115,939 disclose labels that are attached to two of the exterior surfaces of bottles, but which have a cooperative relationship. That is, the labels contain information or decorative features which interrelate when viewed.

Another type of label or decorative feature is one that is suspended within the container. That is, it is not attached to the wall of a container. Such labels are disclosed in U.S. Pat. No. 713,606 and U.S. Pat. No. 956,937. A related label is shown in U.S. Pat. No. 2,356,399 where the label has essentially the shape of the interior of the bottle. A medical label that is within a container but not attached to a surface of the container is disclosed in U.S. Pat. No. 4,871,077. A related decoration is disclosed in Japan 404201853A with the additional disclosure that the decoration can be three dimensional.

The structure of labels or decorative items within containers was addressed in U.S. Pat. No. 1,842,987 where it is disclosed that the decorative part of a label or decoration is covered with a vehicle which is not soluble in the material contained in the container or in the alternative, the label or other decoration is interposed between two films. This patent addresses the stability of the design on the label or decoration and discloses ways to protect the design from deterioration by the substances within the container.

In the present containers there is used a film, and preferably a laminate film, to provide a decoration within a bottle.

The decoration preferably interrelates with a decoration on one of the major side surfaces of the bottle. The bottle preferably is a plastic bottle and the laminate is likewise a plastic which can be the same plastic. On a further preferred embodiment the laminate, except for the decoration, should have essentially the same refractive index as the contained liquid. In this way the laminate, other than the decoration, disappears in the contained liquid. In a further preferred embodiment, the plastic that comprises the container should likewise be the plastic of the laminate. Additionally, the laminate can be stabilized within the container by a particular structure of the container.

BRIEF DESCRIPTION OF THE INVENTION

The present invention is directed to a decorative film insert label within a transparent or essentially transparent container. This is a container wherein at least one surface is transparent. The container can be of essentially any shape but usually will be elliptical to rectangular in shape. In one embodiment the container has an upper opening that is significantly less in diameter than a cross-sectional dimension of the container. In another embodiment the container has a pump mechanism which extends from the upper opening to adjacent the bottom of the container. The decorative film can partially or fully surround the dip tube of the pump mechanism. In a further embodiment the container has means such as grooves or projections on the inner surface to stabilize the decorative film within the container.

The decorative film insert is preferably a laminate and is elliptical to rectangular in shape. It also can be a coated plastic sheet with the coating protecting the decoration on the film. The laminate in a preferred embodiment has rounded lower edges to provide for ease of insertion into the upper opening of the container. In pump containers it can have a notch at the upper edge to laterally stabilize the film against the pump dip tube. The decorative film in a further embodiment has a generally similar refractive index as the contained liquid which then results in the portions of the film not carrying a decoration disappearing in the liquid in the container. The design has the appearance of floating in the contained liquid.

The film insert in one embodiment is made of the same plastic material as the bottle. These plastic materials can be polyenes such as polyethylene, and polypropylene, polyvinyl chloride, polycarbonates, polyacrylates, cellulosics and polyesters such as polyethylene terephthalate and polybutylene terephthalate as well as other plastics suitable for making containers. By using the same plastic materials the visual affect is enhanced by the refractive index of the container and the laminate being esentially the same. Further the plastic that is chosen must not be affected by the liquid product within the container. In a further embodiment the container is comprised of one plastic and the insert of another plastic. For purposes of this disclosure a laminate of two different plastics is considered a different plastic even though one layer of the laminate is the same plastics as the bottle.

The film insert will have a thickness of from about 0.02 mm to about 0.4 mm. The laminate form is comprised of two or more layers, and preferably two layers. The base layer can be of from about 0.02 mm to about 0.3 mm and the top layer and any adhesive layer the remainder of the laminate thickness. The laminate can be formed by direct thermal bonding or adhesively bonding the layers. When an adhesive is used, it must not be affected by the liquid in the container, otherwise there will be delamination. Useful adhesives are pressure sensitive adhesives, heat cured adhesives, ultra violet cured adhesives and electron beam cured adhesives. The film insert can have a length of about 50 to about 100 percent or more of the length of the container and a width of about 75 to about 125 percent or more of the width of the container.

BRIEF DESCRIPTION OF THE DRAWINGS

FIG. 1 is a cross-section of the structure of a two layer laminate decorative film.

FIG. 2 is an elliptical shaped decorative film insert.

FIG. 3 is a rectangular shaped decorative film insert with rounded lower edges.

DETAILED DESCRIPTION OF THE INVENTION

Figure 4:
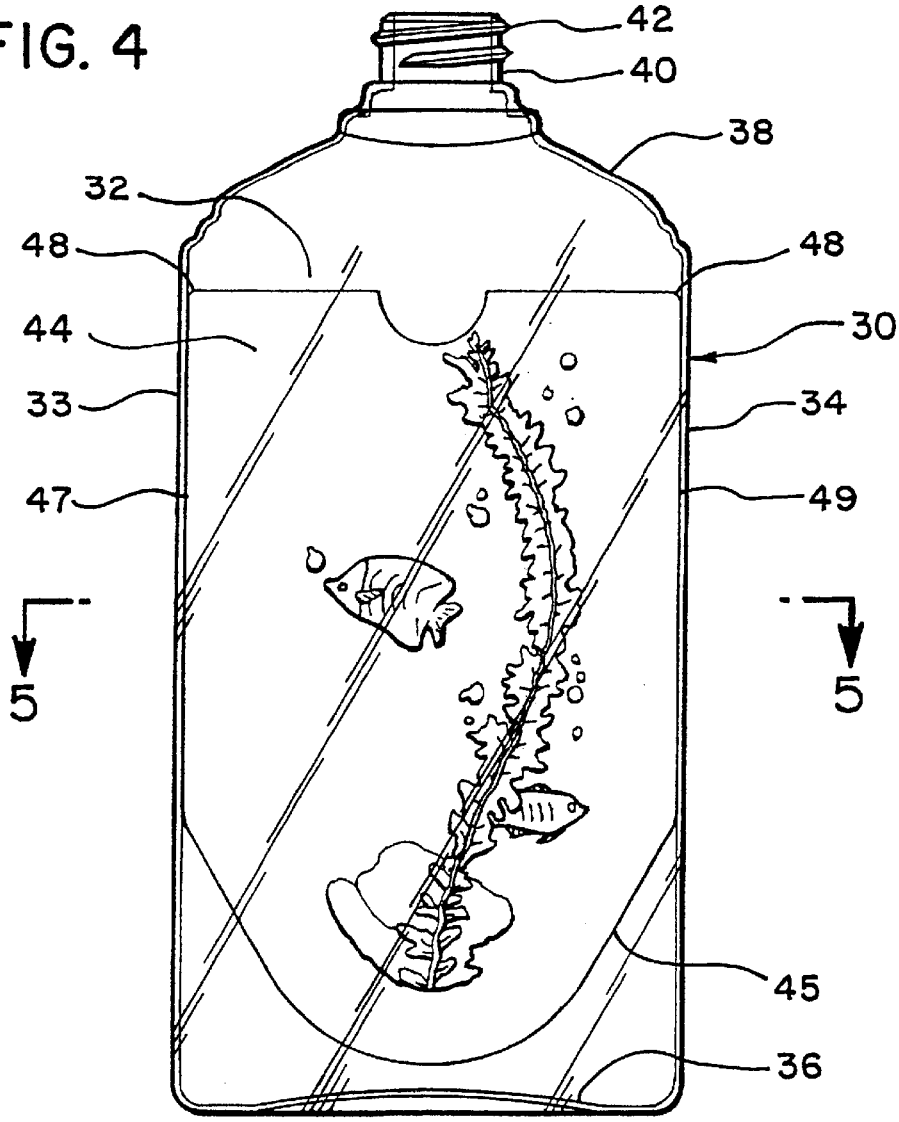
FIG. 4 is an elevational view of the decorative film insert in a bottle.

The decorative film inserts can be a single layer of film with a decoration printed onto the surface and optionally covered with a coating or they can be laminates. This decoration when printed onto the surface then is covered with a coating such as a varnish in order to protect the pattern of the decoration from the liquid in the bottle. As a single layer of film it will have a thickness of about 0.02 mm. to about 0.4 mm., and preferably about 0.05 mm to about 0.3 mm. The coating protecting layer can be a polyurethane or ultraviolet curable acrylate based material. The coating can be applied by rolling onto the surface of the film and will have a thickness of up to about 0.03 mm, and preferably up to about 0.01 mm. The decoration will be of fish, animals, plants, structures, cartoon characters and the like. There are no limitations.

In FIG. 1 there is shown a preferred structure for the film insert which is laminate 10. This laminate consists of base layer 12, adhesive layer 14 and overlayer 16. The laminate will have a thickness of about 0.02 mm to about 0.4 mm. The base layer has a thickness of about 0.02 mm. to about 0.3 mm., and preferably about 0.05 mm. to about 0.15 mm. The adhesive layer 14 has a thickness of about 0.005 mm. to about 0.03 mm. The plastic film overlayer 16 will have a thickness of about 0.01 mm. to about 0.1 mm., and preferably about 0.02 mm. to about 0.05 mm.

The films preferably are comprised of any flexible film that is at least partially transparent. The films must be flexible since they must be rolled into a tubular-like shape for insertion through the fill opening of the container. Suitable plastics for the films include polyenes such as polyethylene (both high and low density), polypropylene, polyethylene copolymers and polypropylene copolymers, polyvinyl chloride, polycarbonates, polyamides, cellulosics, polyethylene terephthalate and polybutylene terephthalate. The choice of films will, to a degree, determine the thickness of the films. Suitable plastics for the container include transparent and translucent plastics including those that are used for the films. The plastics that are used for the film and for the container can be the same or different plastics. These can be of a monolayer structure or of a multilayer structure, such as a laminate. For instance the container can be of a monolayer structure while the film is of a laminate structure.

The films may also be tinted with a color as may be needed to enhance the decoration on the film or on the film in conjunction with the decoration and designs that are on the bottle. In addition the film may be tinted with a color to mask a color of the liquid in the container and/or of the container. For instance if the liquid in the bottle has a yellow or yellow-green tint a blue tint in the film insert will cancel out the yellow or yellow-green tint of the liquid. In this way the tinting of the film insert will enhance the visual appearance of the container.

The decoration is put onto the film surface by a printing technique such as screen or letterpress printing. The decoration also can be a holographic image. It is preferred to use ultraviolet curable inks with each color applied and quickly set. It also is preferred that the decoration cover at least 25 percent, and preferably at least 50 percent of the surface area of the film onto which it is printed. This creates an irregular surface which provides for easier film handling. The films also can have a matte or other such finish to create an irregular surface but yet essentially disappear in the liquid in which it will be immersed to give a transparent appearance. For laminate films the decoration will be on an internal surface of the laminate. That is, it is on a surface of a film that will be abutted by the surface of another film.

If the film insert is to be a monolayer plastic it will have a coating to protect the decoration. The coating is added as a last step. An ultraviolet light curable coating is preferred although heat, catalytic and other cured coatings can be used. When the film insert is a laminate, the film layer that bears the design can be coated with an adhesive and overlayed with a second plastic film layer. The adhesive, if it is not a pressure sensitive adhesive, is cured by heat, ultraviolet light, or other energy source as appropriate. If no adhesive is used, the layers can be heat bonded together. As noted the laminate layers can be comprised of essentially any plastic film that is at least partially transparent.

The decoration also can be a film of low to no light transmittance but which has openings such as in the shapes of fish, animals, flowers, structures and other objects and characters such as cartoon characters. In such a case the shape of the openings will provide the decoration. This can be a plastic or metallic film. This decoration will coordinate with a decoration on the front surface and rear surface.

The adhesives that can be used for the laminate films include solvent based adhesives, pressure sensitive adhesives, ultra-violet cured adhesives, heat cured adhesives and other similar reactive systems. Suitable pressure sensitive adhesives are acrylate based adhesives. Ultra violet light cured adhesives likewise are acrylate based adhesives. Suitable heat cured adhesives can be polyethylene and polyethylene copolymer adhesives. All such adhesives are commercially available.

The film inserts can be in an elliptical shape as shown by film 20 in FIG. 2 or can be in an essentially rectangular shape with rounded lower corners 24 as shown by film 22 in FIG. 3. In FIG. 2 the fish designs are shown as openings through the film. For rectangular shaped film inserts the bottom corners 24 should be rounded (see FIG. 3) to being parabolic in shape (see FIG. 4) in order to assist in inserting the film into the container. This particularly is the case when the films are to be inserted into the containers automatically. The upper corners 26 can be at right angles. A notch 28 laterally stabilizes the upper part of the film in pump containers. The notch accommodates the dip tube of the pump.

FIG. 4 is a view of a film insert in a bottle 30. This film has a decorative fish design for illustration purposes only. Any decorative design can be used. The bottle has front wall 32 side walls 33 and 34, and bottom surface 36. At the top of the bottle is shoulder 38 and neck 40. Neck 40 has threads 42. The film insert 44 is shown as having a parabolic shape 45. Upper corners 48 are shown as being at essentially a right angle. However, these also can be rounded or be of some other shape. The side edges 47 and 49 are shown as straight but these also may be of a different shape.

Figure 5:
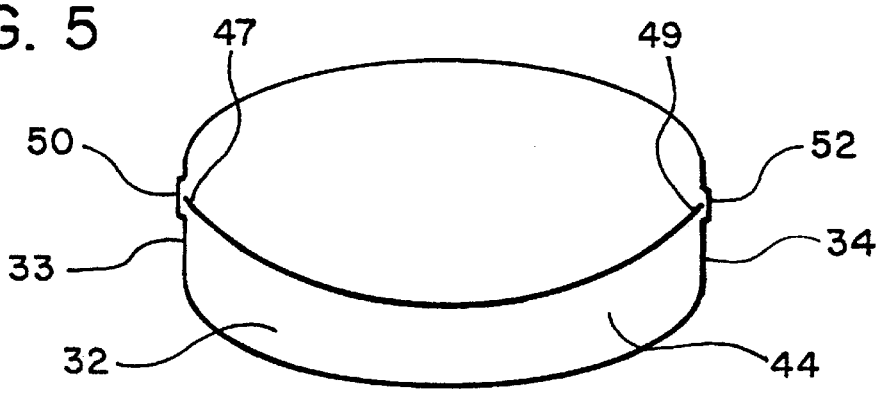
FIG. 5 is a cross-sectional view of a bottle with grooves to stabilize the decorative film insert.

FIG. 5 is a cross-section of the bottle of FIG. 4 showing the embodiment where side walls 33 and 34 contain grooves 50 and 52 to stabilize the film insert. The film longitudinal edges 47 and 49 interfit into grooves 50 and 52 respectively. In this way the film is stabilized in the container.

Figure 6:
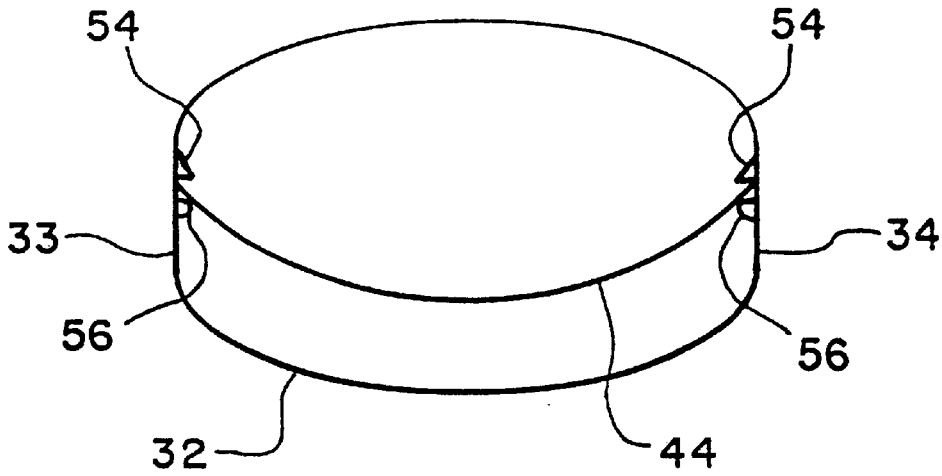
FIG. 6 is a cross-sectional view of a bottle with projections to stabilize the decorative film insert.

FIG. 6 is a variation of the stabilizing technique of FIG. 5. In this embodiment the longitudinal edges of film 44 fit between projections 54 and 56. These projections also serve to stabilize the film insert 44 in the bottle. These projections can be continuous or discontinuous along the inner wall of the bottle.

Figure 7:
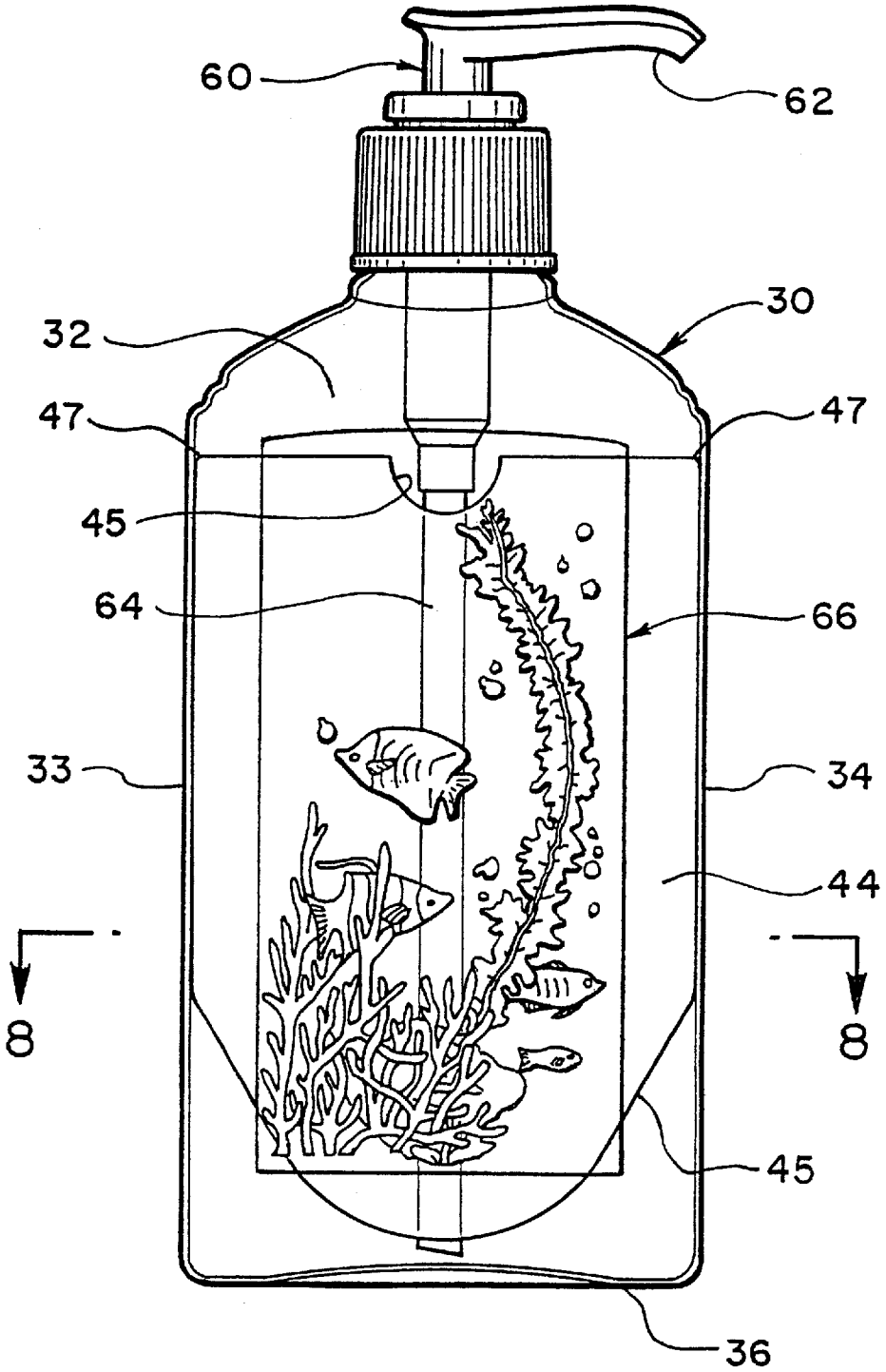
FIG. 7 is an elevational view of a bottle with a pump mechanism and a decorative film insert.

FIG. 7 shows a bottle with a pump mechanism having a film insert 44 within the container. This bottle is that of FIG. 4 but with a pump threadily attached to the bottle. The pump 60 has a dispensing nozzle 62 and a dip tube 64. The dip tube is located behind the film insert 44. Notch 45 stabilizes the film insert against the dip tube.

Figure 8:
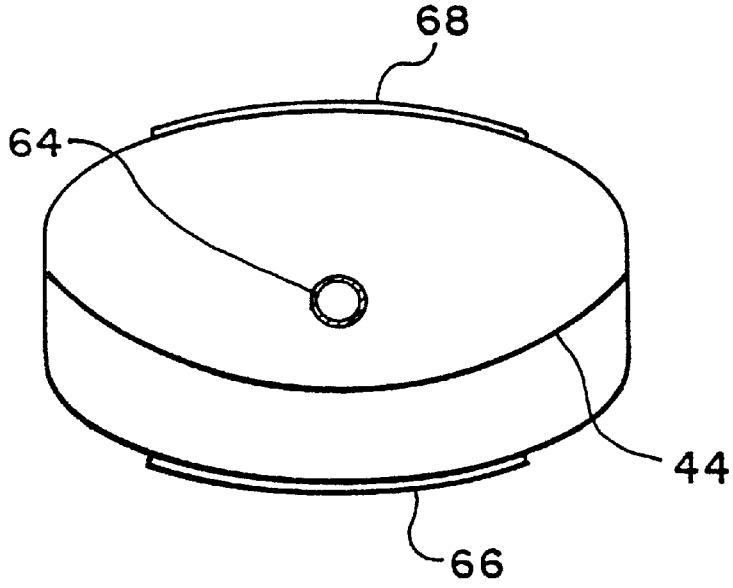
FIG. 8 is a cross-sectional view of a bottle with correlating front and rear labels and a decorative film insert.

In FIG. 8 there is shown an interrelationship between the film insert 44 and a label 66 on the front surface of the bottle and a label 68 on the rear surface of the bottle. The container here is transparent as also is the film insert 44. The film insert 44 and the front and rear labels have complementary designs to give a deep three dimensional affect. The front and rear labels are shown on the exterior surfaces but they can be on the interior surfaces.

The liquids that are contained in the containers can be various personal care or household care products. These can be transparent or semi-transparent liquid, gels and solids. This includes soaps, lotions, shampoos, mouthwash, kitchen cleaning products and bathroom cleaning products. The only requirement is that the products should not attack or otherwise affect the film insert. This includes affecting the films, adhesives or coatings. Additionally in laminates they should not attack the adhesive and cause any delamination. For monolayer films there should be a protective coating over the printing and the coating cannot be attacked by the contained product. The components of these products include water, soaps, detergents, foaming agents. alcohol and perfumes as the major components. The films, adhesives, inks and coatings must be stable when exposed to such substances.

In one mode the films and the containers are constructed using similar materials. This assures the compatability of the various components of the container. In addition, it is preferred further that substance packaged in the container also have a refractive index that is similar to that of the container plastic and/or insert film. In the case where the film insert has a refractive index similar to that of the contained product, the film insert visually disappears in the liquid except for the messages or decoration on the film. The message or decoration appears to float in the container. In a pump bottle when the dip tube of the pump assembly also has a refractive index similar to that of the liquid the dip tube will disappear.

The containers are filled with a product either before or after the insertion of the film. In order to insert the film, the film, whether a monolayer or laminate must be formed into an open or closed tubular or fan-like shape and inserted in through the neck opening of the bottle. Once in the bottle the film expands to its full width. As an alternative, when the bottle has a pump, the film can be wrapped around the dip tube and inserted into the bottle with the pump. The film can be held in a tubular shape by an adhesive that is soluble in the product filled into the bottle. In such a case the product will dissolve the adhesive and the film will open to fill the bottle. In one embodiment dried product can be used as an adhesive to hold the film in a tubular shape. A closure is applied to the bottle after filling. This can be a pump closure.

It also is a preferred embodiment that the films have a decoration coverage of at least thirty percent of the film surface and preferably more than about fifty percent of the film surface. Also, the exterior surfaces if the film insert can have a matte finish. This assists in separating the film inserts for insertion into the bottles.

The invention will be disclosed in more detail with reference to the following examples.

EXAMPLE 1

A base layer of transparent polyethylene terephthalate film having a thickness of 0.1 mm is printed using ultraviolet curable letterpress and screen inks. A white ink is first applied by screen printing and cured with ultraviolet radiation. The printed decoration is a school of fish in different colors printed over the cured white ink using letterpress printing and cured with ultraviolet radiation. An acrylate base ultraviolet curable adhesive (LA Flexo from Northwest Coatings) is applied onto the printed surface of the base film and overlayed with a film of 0.025 mm thick polypropylene. The adhesive is then cured with ultraviolet light. The cured laminate structure is cut to the proper size and to have rounded corners for insertion into bottles. There is a notch at the upper edge since the bottle has a pump assembly. The films are inserted into the bottles, the bottles filled with a Softsoap antibacterial hand soap and capped with a pump closure. Laminated structures as prepared in Example 1 show no delamination after 8 weeks at 120F.

EXAMPLE 2

A base layer of transparent polyethylene terephthalate film having a thickness of 0.13 mm is printed using ultraviolet curable letterpress and screen inks. A white ink is first applied by screen printing and cured with ultraviolet radiation. The printed decoration is an aquarium scene in different colors printed over the cured white ink using letterpress printing and cured with ultraviolet radiation. An acrylate base ultraviolet curable adhesive is applied onto the printed surface of the base film and overlayed with a film of 0.025 mm thick polypropylene. The adhesive is then cured with ultravioilet light. The cured laminate structure is cut to the proper size and to have rounded corners for insertion into bottles. There is a notch in the upper edge since the bottle has a pump assembly. The films are inserted into the bottles, the bottles filled with an antibacterial hand soap, and capped with a pump closure. This film exhibited no delamination after 13 weeks at 110F.

EXAMPLE 3

A base layer of transparent polyethylene terephthalate film having a thickness of 0.13 mm is printed using ultraviolet curable letterpress and screen inks. A white ink is first applied by screen printing and cured with ultraviolet radiation. The printed decoration is an aquarium scene in different colors printed over the cured white ink using letterpress printing and cured with ultraviolet radiation. A polyethylene copolymer heat activated adhesive is applied onto the printed surface of the base film and overlayed with a film of 0.0125 mm thick polyethylene terephthalate. The adhesive is thermally activated and bonds the two layers together to produce a clear laminated film. The cured film is cut to the proper size and to have rounded comers for insertion into bottles. The films are inserted into clear polyethylene terephthalate bottles containing an aquarium theme label on the front panel of the bottle. The bottles are filled with antibacterial liquid soap and capped with a pump closure. This film demonstrated no delamination after being stored at 120F for 13 weeks.

EXAMPLE 4

A base layer of transparent polyethylene terephthalate film having a thickness of 0.13 mm is printed using ultraviolet curable letterpress and screen inks. A white ink is first applied by screen printing and cured with ultraviolet radiation. The printed decoration is an aquarium scene in different colors printed over the cured white ink using letterpress printing and cured with ultraviolet radiation. A polyethylene copolymer heat activated adhesive is applied onto the printed surface of the base film and overlayed with a film of 0.025 mm thick polyethylene terephthalate. The adhesive is thermally activated bonding the two layers together to produce a clear laminated film. The cured film is cut to the proper size and to have rounded comers for insertion into bottles The films are inserted into clear polyethylene terephthalate bottles containing an aquarium theme printed label on the rear panel of the bottle. The bottles are filled with antibacterial liquid soap and capped with a pump closure. The inserted film gives the three dimensional appearance of a real aquarium. This film demonstrated no delamination after being stored at 120F for 13 weeks.

EXAMPLE 5

A base layer of transparent polyethylene terephthalate film having a thickness of 0.08 mm is printed using ultraviolet curable letterpress and screen inks. A white ink is first applied by screen printing and cured with ultraviolet radiation. The printed decoration is an aquarium scene in different colors printed over the cured white ink using letterpress printing and cured with ultraviolet radiation. A polyethylene copolymer heat activated adhesive is applied onto the printed surface of the base film and overlayed with a film of 0.08 mm thick polyethylene terephthalate. The adhesive is thermally activated bonding the two layers together to produce a clear laminated film. The cured film is cut to the proper size and to have rounded comers for insertion into bottles. The films are inserted into clear polyethylene terephthalate bottles containing an aquarium them printed label on the rear panel of the bottle. The bottles are filled with antibacterial liquid soap and capped with a pump closure. The inserted film gives the three dimensional appearance of a real aquarium. This film demonstrated no delamination after being stored at 120F for 13 weeks.

EXAMPLE 6

A base layer of transparent polyethylene terephthalate film having a thickness of 0.13 mm is printed using ultraviolet curable letterpress and screen inks. A white ink is first applied by screen printing and cured with ultraviolet radiation. The printed decoration is an aquarium scene in different colors printed over the cured white ink using letterpress printing and cured with ultraviolet radiation. An overlaminate film of 0.025 mm thick polyethylene terephthalate coated with a pressure sensitive acrylate based adhesive is applied to the printed surface which bonds the two layers together producing a clear laminated film. The laminated film is cut to the proper size and to have rounded comers for insertion into bottles. This film demonstrated no delamination after being stored at 120F for 13 weeks.

EXAMPLE 7

A base layer of transparent polyethylene terephthalate film having a thickness of 0.13 mm is printed using ultraviolet curable letterpress and screen inks. A white ink is first applied by screen printing and cured with ultraviolet radiation. The printed decoration is an aquarium scene in different colors printed over the cured white ink using letterpress printing and cured with ultraviolet radiation. A coating of a clear acrylate based varnish is then applied to the printed surface of the base film and cured with ultraviolet light. The coated film is cut to the proper size and to have rounded comers for insertion into bottles. The film of Example 7 demonstrated no visually perceptable deterioration of the UV coating and little fading of the printed image (0.25 on a scale of 0 to 3.0) after being stored at 120F for 13 weeks.

EXAMPLE 8

A base layer of transparent polyethylene terephthalate film having a thickness of 0.13 mm is printed using ultraviolet curable letterpress and screen inks. A white ink is first applied by screen printing and cured with ultraviolet radiation. No coating or overlaminate film is applied to the printed base film. Laminated films as prepared in Examples 2 and 3 were evaluated versus this unlaminated film for the level of unreacted acrylate monomers and excess photoinitiators after extended water immersion of the films. The protective effect of the overlaminate films is demonstrated below.

| Laminate from | Unreacted acrylate monomer (ppb) | Photoinitiator A (ppb) | Photoinitiator B (ppb) |
|---|---|---|---|
| Example 2 | 8 | <1 | 10 |
| Example 3 | 4 | <1 | 22 |
| Example 8 | 20 | 32 | 250 |

The uncoated film of Example 8 exhibited a significant loss of color when immersed in product at elevated temperature (3 on a scale of 0 to 3). The laminated structures of Examples 2 and 3 exhibited only a slight loss of color (0.25 on a scale of 0 to 3) when tested under the same conditions.

The invention has been described with reference to the more preferred embodiments. Variations of these embodiments are considered to be Within the present inventive concept.

We claim:

1. A packaged product comprising a container that has at least one surface that is essentially transparent and which has a design on at least one surface thereof;

(a) a product in said container wherein said product is at least partially transparent;

(b) a film insert in said container, said film insert having a length and a width each of which is from about one half to greater than the respective internal dimension of the container, said film insert having a design that is complementary to a design on at least one surface of the container; and (c) said film insert being a layer of film with a decoration on a surface thereof, a cured coating overlaying said decoration to provide a barrier between said decoration and said product.

2. A packaged product as in claim 1 wherein there is a complementary design on a second surface of said container, said designs being in a line of sight alignment.

3. A packaged product as in claim 1 wherein the material of said film insert and the material of said container are different.

4. A packaged product as in claim 3 wherein at least one of said container and said film insert is comprised of a plastic selected from the group consisting of polyenes, polyesters, styrenes, polycarbonates, polyvinyl chlorides, polyacrylates, polyamides, cellulosics, and transparent and translucent copolymers and mixtures thereof.

5. A packaged product as in claim 1 wherein said film insert is a laminate having at least two layers with a decoration on a surface of one of said layers.

6. A packaged product is in claim 5 wherein said at least two layers are comprised of a same plastic.

7. A packaged product as in claim 5 wherein said at least two layers are comprised of different plastics.

8. A packaged product as in claim 7 wherein at least one of said film insert and said container is formed primarily of polyethylene terephthalate.

9. A packaged product as in claim 7 wherein said film insert is a laminate containing polyethylene terephthalate and a polyene containing polymer.

10. A packaged product as in claim 1 wherein said film insert is rectangular in shape with rounded lower edges.

11. A packaged product as in claim 1 wherein said film insert is rectangular in shape with a parabolic shaped lower portion.

12. A packaged product as in claim 1 wherein said film is elliptical in shape.

13. A packaged product as in claim 1 wherein a plastic of said container, a plastic of said film insert and the product within said container have a refractive index within about 0.5 of an other.

* * * * *